US010119338B2

(12) United States Patent
Thomas et al.

(10) Patent No.: US 10,119,338 B2
(45) Date of Patent: Nov. 6, 2018

(54) CONTROLLED BLADE FLEX FOR FIXED CUTTER DRILL BITS

(71) Applicant: Halliburton Energy Services, Inc., Houston, TX (US)

(72) Inventors: Jeffrey Gerald Thomas, Magnolia, TX (US); Clayton Arthur Ownby, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 162 days.

(21) Appl. No.: 15/034,206

(22) PCT Filed: Dec. 11, 2013

(86) PCT No.: PCT/US2013/074334
§ 371 (c)(1),
(2) Date: May 4, 2016

(87) PCT Pub. No.: WO2015/088508
PCT Pub. Date: Jun. 18, 2015

(65) Prior Publication Data
US 2016/0273274 A1 Sep. 22, 2016

(51) Int. Cl.

| | |
|---|---|
| ***E21B 10/43*** | (2006.01) |
| ***E21B 7/04*** | (2006.01) |
| ***E21B 10/46*** | (2006.01) |
| *E21B 10/08* | (2006.01) |
| *E21B 43/24* | (2006.01) |
| *E21B 47/12* | (2012.01) |
| *E21B 47/18* | (2012.01) |

(52) U.S. Cl.
CPC ..... *E21B 10/43* (2013.01); *E21B 7/04* (2013.01); *E21B 10/46* (2013.01); *E21B 10/08* (2013.01); *E21B 43/2406* (2013.01); *E21B 47/12* (2013.01); *E21B 47/123* (2013.01); *E21B 47/18* (2013.01)

(58) Field of Classification Search
CPC . E21B 10/43; E21B 7/04; E21B 10/46; E21B 10/08; E21B 43/2406; E21B 47/12; E21B 47/123; E21B 47/18; E21B 10/42; E21B 10/62
See application file for complete search history.

(56) References Cited

U.S. PATENT DOCUMENTS

| | | | |
|---|---|---|---|
| 7,845,436 | B2 | 12/2010 | Cooley et al. |
| 8,061,455 | B2 | 11/2011 | Beuershausen |
| 8,215,418 | B2 | 7/2012 | Radford et al. |

(Continued)

FOREIGN PATENT DOCUMENTS

| | | |
|---|---|---|
| CN | 102678053 | 9/2012 |

OTHER PUBLICATIONS

International Search Report and Written Opinion, Application No. PCT/US2013/074334; 15 pgs, dated Sep. 15, 2014.

*Primary Examiner* — Yong-Suk Ro
(74) *Attorney, Agent, or Firm* — Baker Botts L.L.P.

(57) ABSTRACT

A drill bit includes a drill bit body and a flexible blade positioned on the drill bit body. The drill bit further may include a cutting element coupled to and extending a distance beyond a face of the flexible blade. The cutting element may have a back rake angle and a side rake angle. At least one of the distance, back rake angle, and side rake angle may depend on a flexed position of the flexible blade.

20 Claims, 9 Drawing Sheets

(56) References Cited

U.S. PATENT DOCUMENTS

| | | | | |
|---|---|---|---|---|
| 2008/0000693 | A1 | 1/2008 | Hutton | |
| 2009/0044979 | A1 | 2/2009 | Johnson et al. | |
| 2010/0108401 | A1* | 5/2010 | Lanning | E21B 10/54 175/426 |
| 2011/0073370 | A1 | 3/2011 | Gentry | |
| 2011/0192651 | A1* | 8/2011 | Lyons | E21B 10/5673 175/428 |
| 2012/0292115 | A1 | 11/2012 | Pafitis et al. | |
| 2013/0146370 | A1* | 6/2013 | Zahradnik | E21B 10/42 175/431 |

* cited by examiner

CONTROLLED BLADE FLEX FOR FIXED CUTTER DRILL BITS

RELATED APPLICATION

This application is a U.S. National Stage Application of International Application No. PCT/US2013/074334 filed Dec. 11, 2013, which designates the United States, and which is incorporated herein by reference in its entirety.

BACKGROUND

The present disclosure relates generally to well drilling operations and, more particularly, to controlled blade flex for fixed cutter drill bits.

Hydrocarbon recovery drilling operations typically require boreholes that extend hundred and thousands of meters into the earth. The drilling operations themselves can be complex, time-consuming and expensive. The rate at which a borehole can be drilled depends on numerous factors such as the geological type of the formation, drilling torque, the weight on a drill bit during drilling operations, and the characteristics of the drill bit. One example drill bit characteristic is the depth with which cutting elements of the drill bit engage with the formation. A larger depth may cut the formation more quickly, but also cause the drill bit/cutting elements to wear out faster. Conversely, a smaller depth may cut the formation more slowly, but increase the life of the drill bit.

FIGURES

Some specific exemplary embodiments of the disclosure may be understood by referring, in part, to the following description and the accompanying drawings.

Figure 1:
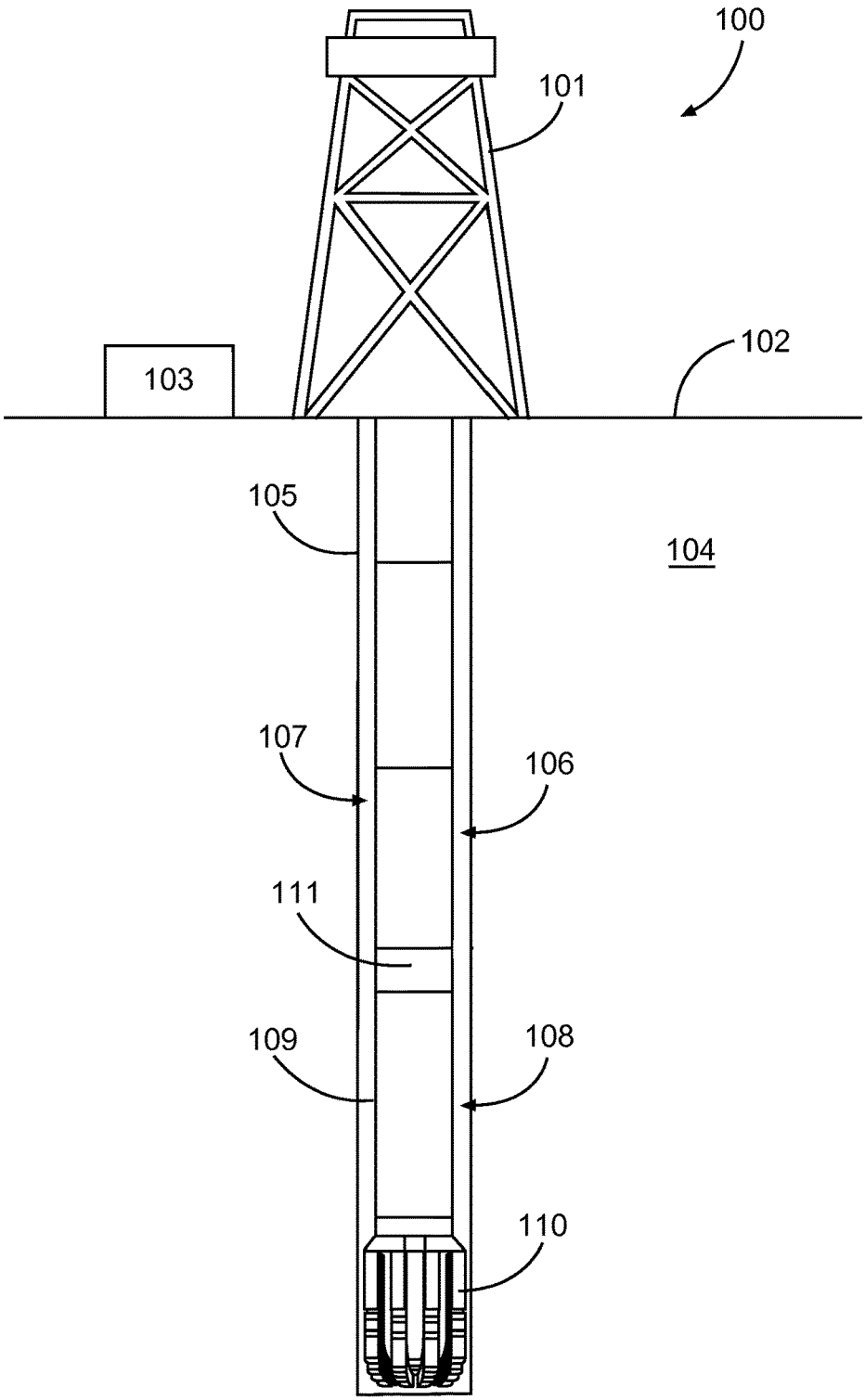
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to controlled blade flex for fixed cutter drill bits.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art apart from the teachings of the present disclosure, and will therefore not be discussed in detail herein. Thus, if a first device communicatively couples to a second device, that connection may be through a direct connection, or through an indirect communication connection via other devices and connections. The indefinite articles "a" or "an," as used in the claims, are defined herein to mean one or more than one of the elements that it introduces.

FIG. 1 shows an example drilling system 100, according to aspects of the present disclosure. The drilling system 100 includes rig 101 mounted at the surface 102 and positioned above borehole 105 within a subterranean formation 104. In certain embodiments, the surface 102 may comprise a rig platform for off-shore drilling applications, and the subterranean formation 104 may be a sea bed that is separated from the surface 102 by a volume of water. In the embodiment shown, a drilling assembly 106 may be positioned within the borehole 105 and coupled to the rig 101. The drilling assembly 106 may comprise drill string 107 and bottom hole assembly (BHA) 108. The drill string 107 may comprise a plurality of drill pipe segments connected with threaded joints. The BHA 108 may comprise a drill bit 110, a measurement-while-drilling (MWD)/logging-while-drilling (LWD) section 109, and a telemetry system 111.

The MWD/LWD section 109 may include a plurality of sensors and electronics used to measure and survey the formation 104 and borehole 105. In certain embodiments, the BHA 108 may include other sections, including power systems, telemetry systems, and steering systems. The drill bit 110 may be a roller-cone drill bit, a fixed cutter drill bit, or another drill bit type that would be appreciated by one of ordinary skill in the art in view of this disclosure. Although drill bit 110 is shown coupled to a conventional drilling assembly 106, other drilling assemblies are possible, including wireline or slickline drilling assemblies.

In certain embodiments, the drilling system 100 may further comprise a control unit 103 positioned at the surface 102. The control unit 103 may comprise an information handling system that is communicably coupled to at least one downhole element, such at the sensor in the MWD/LWD section 109. The control unit 103 may communicate with the MWD/LWD section 109 via at least one communications channel. The communications channel may comprise wireless communications, wired communications, fiber-optic, mud-pulse communications, etc.

In certain embodiments, the telemetry system 111 may comprise a mud pulser, and the control unit 103 may communicate with the downhole elements through mud pulses generated in drilling fluid that is pumped downhole within the drill string 107.

FIGS. 2A-2E are diagrams that show an example fixed cutter drill bit 200, according to aspects of the present disclosure. The drill bit 200 comprises a drill bit body 201 with at least one blade 202. The drill bit body 201 may be manufactured out of steel, for example, or out of a metal matrix around a steel blank core. The blades 202 may be integral with the drill bit body 201, or may be formed separately and attached to the drill bit body 201. The blades 202 may be positioned around an exterior surface of the bit body 201 and project outward, away from the bit body 201. For example, where the blade 202 is positioned on a side of the drill bit 200, the blade 202 may project radially outward from a longitudinal axis 206 of the drill bit 200. Similarly, where the blade 202 is positioned on a bottom of the drill bit 200, the blade 202 may project downward. The outer surface of the blade 202 may comprise a face 206 that is proximate to a formation when the drill bit 200 is drilling.

In certain embodiments, a cutting element 203 may be affixed to the blade 202. In the embodiment shown in FIG. 2B, the cutting element 203 is affixed within a pocket 205 in the blade 202 that is adjacent to the face 206. The cutting element 203 may comprise, for example, a polycrystalline diamond compact (PDC) cutter. The cutting element 203 may include a cutting surface 204 that contacts rock in a formation and removes it as the drill bit 200 rotates. The cutting surface 204 may be at least partly made of diamond. For example, the cutting surface 204 may be partly made of synthetic diamond powder, such as polycrystalline diamond or thermally stable polycrystalline diamond; natural diamonds; or synthetic diamonds impregnated in a bond.

Figure 2A:
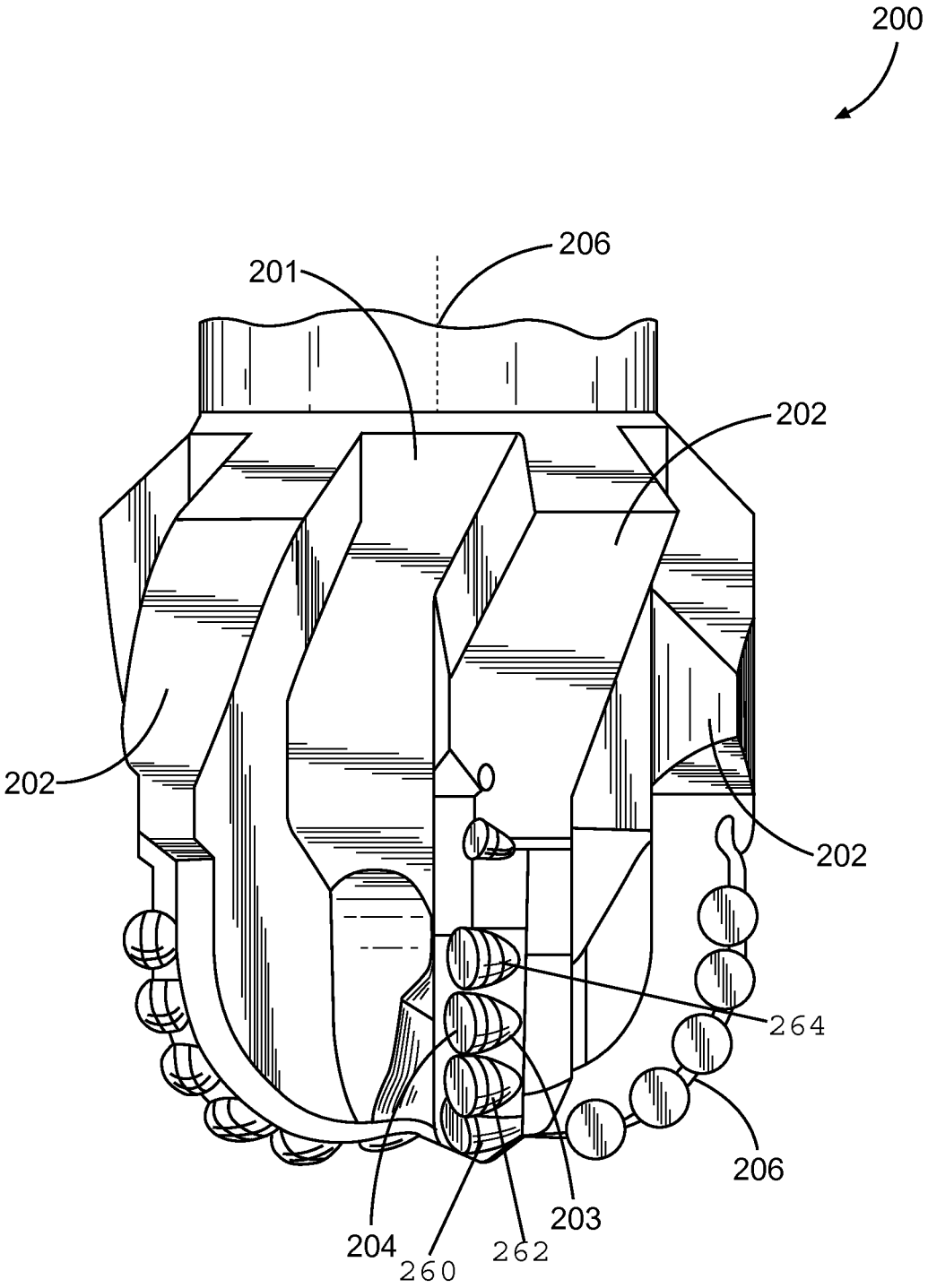
FIGS. 2A-2E are diagrams that show an example fixed cutter drill bit, according to aspects of the present disclosure.
Figure 2B:
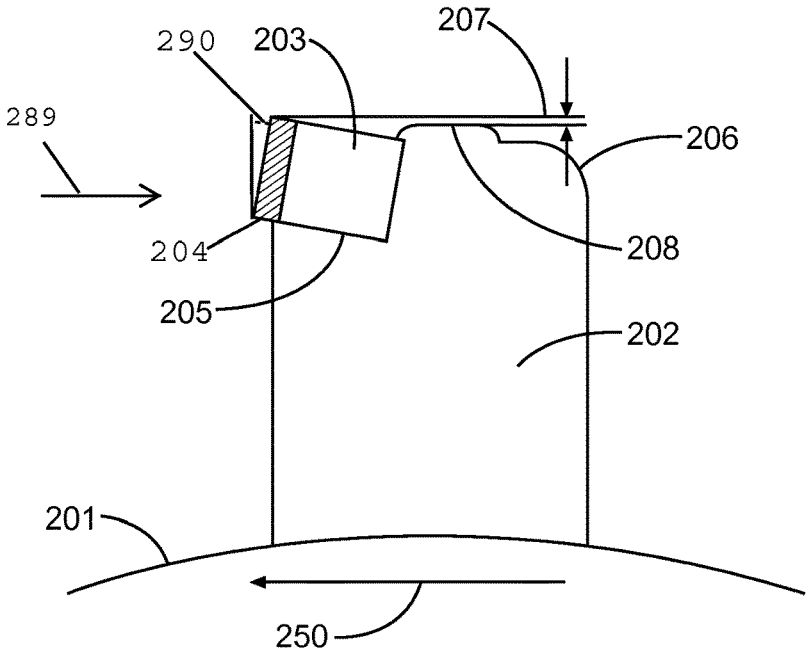

During drilling operations, the cutting element 203, and particularly the cutting surface 204 of the cutting element 203, may cut or "engage" with the formation, removing rock. As can be seen in FIG. 2B, the cutting element 203 is positioned such that an edge of the cutting surface 204 extends a distance 207 beyond the face 206, which may comprise a control element 208 that will be described below. The distance 207 may at least partially define the maximum cut depth achievable by a given cutting element 203. Specifically, once the cutting element 203 begins cutting, the face 206 will contact the formation and prevent the cutting element 203 from cutting any deeper than distance 207. The distance 207 may also be referred to as the "cutter engagement", indicating the extent to which a given cutting element 203 will engage with the formation.

Figure 2C:
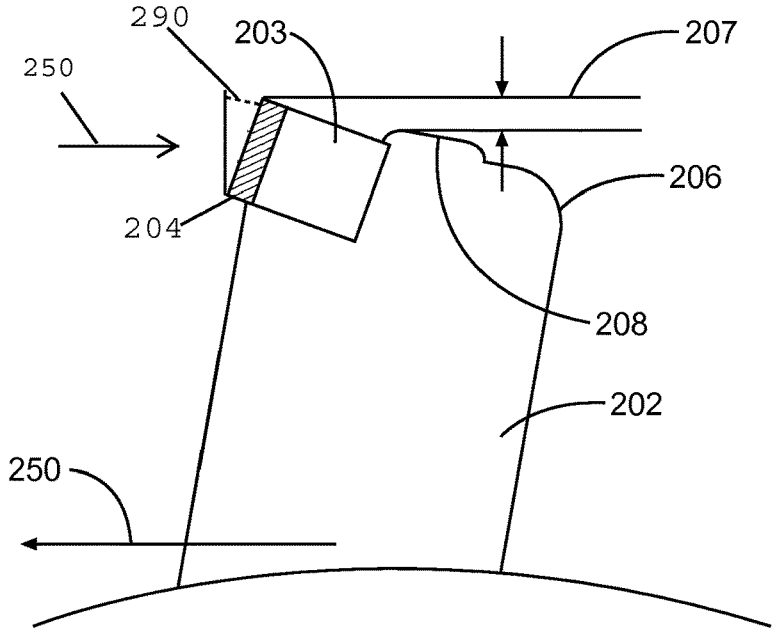
Figure 2D:
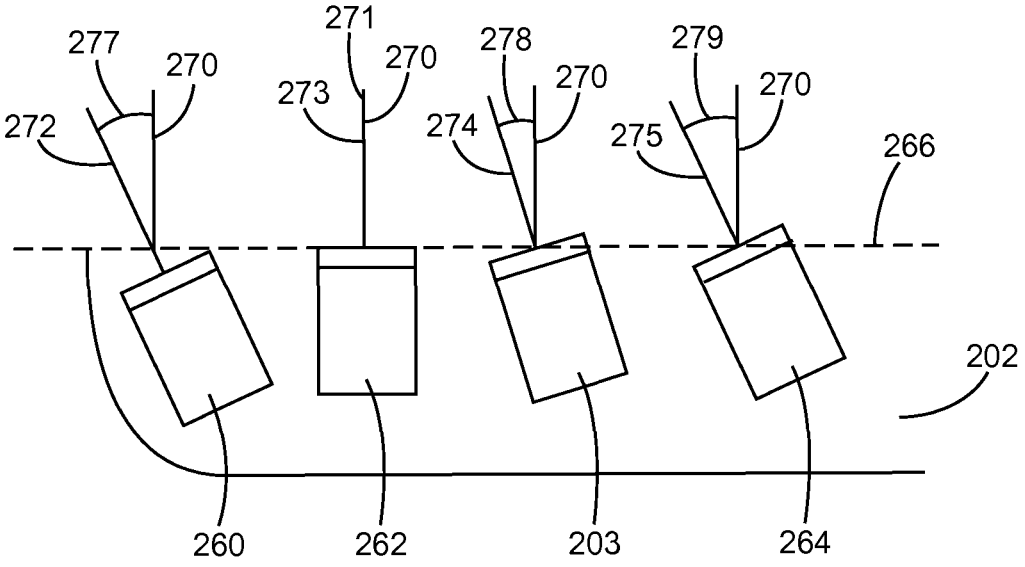

In certain embodiments, the cutting element 203 may be characterized by its angular position with respect to the blade 202 and the surface that the cutting element 203 will contact. One angular position may be referred to as the "back rake" angle of the cutting element 203, identified as angle 290. Another angular position may be referred to as the "side rake" angle. In FIG. 2D, for example, a plurality of individual cutters 260-264 and 203 are positioned having side rake angles 277-279 and 291, respectively. The side rake angles 277-279 and 291 are determined by measuring the angle between imaginary lines 272-275 drawn respectively through the center and perpendicular to a cutting face of the cutters 260-264 and 203 and a tangent line 272 at the center of the cutter, with the tangent line 272 being parallel to the direction of cutting for the cutter when the drill bit is rotated.

Typically, the cutter engagement, back rake angle, and side rake angle for a given cutter is set during the design and manufacturing processes, for example, by selecting the depth and angle of the pocket 205, the size of the cutting element 203, and the presence/size of a control element 208 positioned on the face 206 of the blade 202. As can be seen, the control element 208 may comprise an outward projection of the face 206 that partially defines the distance 207. The pocket 205, cutting element 203, and control element 208 may be configured to establish a particular cutter engagement, back rake angle, and side rake angle. The cutter engagements, back rake angles, and side rake angles may differ from cutting element to cutting element, depending on the location of the cutting elements on the blades of the drill bit. In a typical drill bit, however, the distance, back rake angle, and side rake angle are fixed when the bit is manufactured.

According to aspects of the present disclosure, the distance 207, back rake angle 290 and side rake angle 278 of a cutting element 203 may be controllable and variable while the drill bit 200 is positioned downhole. In certain embodiments, the blade 202 may be flexible, allowing for the distance 207, back rake angle 290 and side rake angle 278 of a cutting element 203 to change when the blade is in a flexed position. As used herein, a flexed position may refer to a range of positions that deviate from a normal, unflexed position of the blade.

Figure 2E:
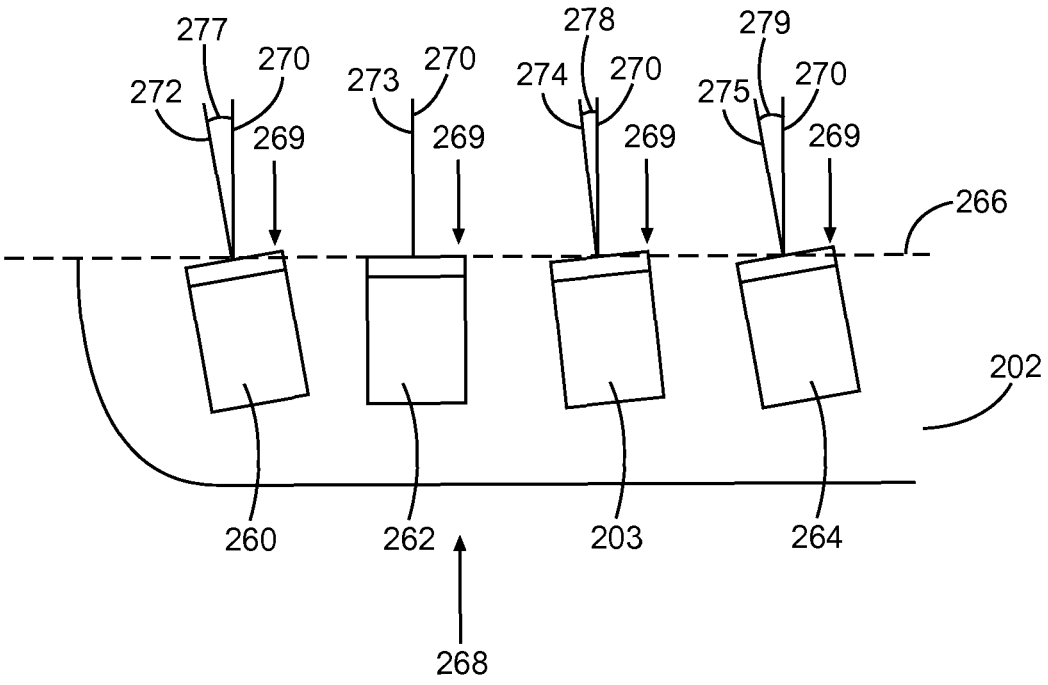

Drilling operations require application of a torque force to the drill bit 200 to cause it to rotate. When the torque force is applied and the drill bit 200 rotates, the formation imparts an opposite force on the blade 202. FIG. 2B includes an arrow 250 indicating the torque force applied to blade 202, and an arrow 289 indicating the opposite force applied to the blade 202. Similarly, FIG. 2D includes an arrow 268 indicating the torque force applied to blade 202, and an arrow 269 indicating the opposite force applied to the blade 202. In the embodiment shown, the opposite forces 269 and 289 are received at the cutting element 203 and transferred to the blade 202. As can be seen in FIGS. 2C and 2E, if sufficient torque force is applied to the drill bit 200, the opposite force transferred to the blade 202 elastically strain the blade, forcing it into a flexed position from its normal position. With respect to FIG. 2C the flexed position comprises a bend in blade away from the direction of arrow 250. With respect to FIG. 2E, the flexed position comprises twisting along the length of the blade 202. In certain embodiments, the blade 202 may comprise a first material with a modulus of elasticity that provides flex under typical downhole drilling conditions, including but not limited to temperatures, pressures, weights-on-bit, and torques-on-bit that would be appreciated by one of ordinary skill in view of this disclosure. In certain embodiments, the blade 202 may be at least partially manufactured of the first material. In other embodiments, the first material may be incorporated into the blade 202 as a separate insert.

When the blade 202 flexes, the distance 207 changes as does the back rake angle 290 and the side rake angle 278 of the cutting element 203, with the amount of change depending on the strength of the opposite forces 269 and 289 and the modulus of elasticity of the blade 207. By changing the distance 207, back rake angle 290, and/or side rake angle 278, the depth of the cut by the cutting element 203, and the amount of rock removed from the formation during every rotation of the drill bit 200 may be changed. Varying the distance 207 downhole may allow for the depth of the cut to be controlled in real-time or near real-time. Varying the back rake angle 290 and side rake angle 278, in contrast, may provide for dynamic force and energy balancing, as the back rake angle 290 and side rake angle 278 of the cutting element 203 and the resulting angles with which the cutting element 203 engages a formation change the magnitude of the opposite force 260 received at the blade 202.

The distance 207, back rake angle 290, and side rake angle 278 may be controlled for numerous purposes. For example, when a soft formation is encountered, the distance 207 may be increased, increasing the depth of the cut and decreasing the overall drill time. Likewise, in harder formations, the distance 207 can be optimized to balance the rate of penetration of the drill bit versus the useful life of the drill bit.

According to aspects of the present disclosure, changing the distance 207, back rake angle 290, and/or side rake angle 278 while the drill bit is positioned within the borehole may comprise forcing the blade into a flexed position. In certain embodiment, forcing the flexible blade into the flexed position may comprise changing a drilling parameter, such as the torque or weight applied to the drill bit 200. Changing a drilling parameter, for example, may change the opposite forces 269 and 289 applied to the blade 202, and therefore the amount of flex in the blade 202 and the distance 207, back rake angle 290, and side rake angle 278. The torque force applied to the bit 200 may be a function of the weight applied to the drill bit 200. Because the amount of flex may be a function of the torque force applied to the drill bit 200, the amount of flex may be controlled by modifying the weight applied to the drill bit 200. In certain embodiments, the amount of flex in the blade 202 may have a positive correlation with the amount of weight applied to the drill bit 200—e.g., an increase in the weight on the drill bit 200 results in an increase in the flex of the blade 202, and a decrease in the weight on the drill bit 200 results in an decrease in the flex of the blade 202. The weight applied to the drill bit 200 may be modified, for example, using equipment positioned at the surface or downhole.

In certain embodiments, the drill bit 200 may comprise a secondary force transfer mechanism that may receive and transfer the opposite force 289 to the blade 202. Example secondary force transfer mechanisms may include dummy cutting elements, impact arrestors, or a modified control element 208. An example dummy cutting element may be similar to cutting element 203 but intended to transfer the opposite force 289 to the blade 202 rather than meaningfully contribute to the removal of rock in the formation. For example, the dummy cutting element may be substantially the same as the cutting element 203, but positioned such that it has a larger cutter engagement when the bit 200 is manufactured. Thus, when the formation is being drilling, the dummy cutting element may contact the formation first and transfer more of the opposite force to the blade 202 than cutting element 203. The increased engagement between the dummy cutting element and the formation may increase the wear on the cutting surface of the dummy cutting element; however, that increased wear may be acceptable if it reduces wear on the remaining cutting elements.

In certain embodiments, the blade 202 may comprise a first material with a modulus of elasticity that varies with at least one secondary condition. As opposed to a material with a relatively stable modulus of elasticity, a material with a variable modulus of elasticity may allow the flexibility of the blade to be increased, limited or otherwise controlled, thereby increasing, limiting or otherwise controlling the amount of change in the distance 207, back rake angle 290, and side rake angle 278 when constant opposite forces 269 and 289 are applied to the blade 202. These secondary conditions may include but are not limited to temperature, pressure, magnetic fields, electrical energy, etc. These secondary conditions may be encountered naturally while the drill bit 200 is positioned downhole, or may be induced using mechanisms within the drill bit 200 or within a BHA near the drill bit 200 to change the modulus of elasticity of the blade 202. For example, electromagnets, electrodes, or other controllable source of electromagnetic (EM) energy may be incorporated into a drilling assembly at or near a drill bit 200. When the source of EM energy is triggered, it may reduce the modulus of elasticity of the first material in the flexible blade 202, providing for increased flexibility in the flexible blade 202 and an increase in the cutter engagements. Conversely, the source of EM energy may be used to increase the modulus of elasticity of the first material and prevent or otherwise limit the flexibility of the flexible blade 202. In certain embodiments, the EM source may be triggered by a control unit located at or near the drill bit. The control unit may comprise an information handling system that generates commands to the EM source or responds to commands from a surface control unit, similar to control unit 103 from FIG. 1.

In certain embodiments, the blade 202 may comprise a first material that selectively maintains a flexed position. For example, the first material may comprise a shape-memory alloy (SMA), which may also be referred to as smart metal, memory metal, memory alloy, muscle wire, or smart alloy. The opposite forces 269 and 289 applied to the blade 202 may, in certain instances, overcome the yield point of the blade 202, leading to plastic deformation. In certain instances, the plastic deformation may be useful; allowing the cutting element 203 to maintain the altered distance 207, back rake angle 290, and/or side rake angle 278 after the weight has been removed from the drill bit 200. In certain instances, however, it may be useful to release the plastic deformation so that the cutting engagement can be selectively controlled and set for a new formation strata. The SMA may "remember" its original shape and return to the pre-deformed shape when heated.

Figure 3:
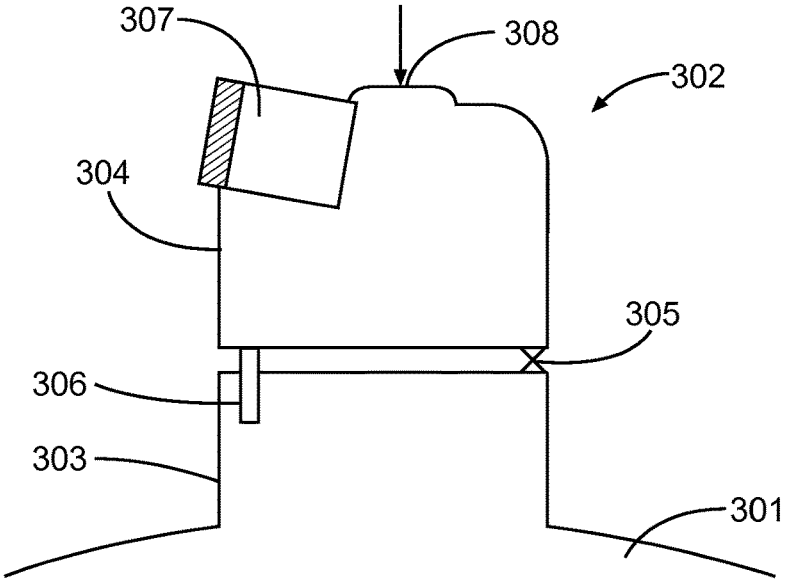
FIG. 3 is a diagram illustrating an example blade of a fixed cutter drill bit, according to aspects of the present disclosure.

According to aspects of the present disclosure, a flexible blade may comprise at least one mechanical, hydraulic, and/or electric mechanism that may be altered to change the distance of the cutter. FIG. 3 is a diagram illustrating a cross-section of an example flexible blade 302 positioned on a drill bit body 301. The flexible blade 302 may comprise a lower portion 303 affixed to or integral with bit body 301. The flexible blade 302 may further comprise an upper portion 304 coupled to the lower portion 303. The upper portion 304 may be coupled to the lower portion by at least one mechanical, hydraulic, and/or electric mechanism. In the embodiment shown, the at least one mechanical, hydraulic, and/or electric mechanism comprises a hinge or flex point 305 and a compressible member 306. The compressible member 306 may be at least partially disposed between the upper portion 304 and the lower portion 303 of the blade 302.

Unlike the embodiment shown in FIGS. 2A-2E which uses a positive correlation between the weight-on-bit and the cutter engagement, the flexible blade 302 uses a negative correlation. In particular, as the weight-on-bit is increased, contact with the formation at the cutting element 307 and face 308 may force the upper portion 304 of the blade 302 toward the lower portion 304 of the blade 302, altering state and/or relative positions of the hinge or flex point 305 and the compressible member 306. The distance between the upper portion 304 and the lower portion 303 may remain substantially the same at the hinge point 305, but may decrease elsewhere due to the compressible member 306, causing the cutter engagement of the cutting element 307 to decrease. In certain embodiments, the compressible member 306 may be resilient such that when the weight on bit is removed or decreased, the compressible member 306 may expand to its original size and shape, increasing the cutter engagement.

Figure 4:
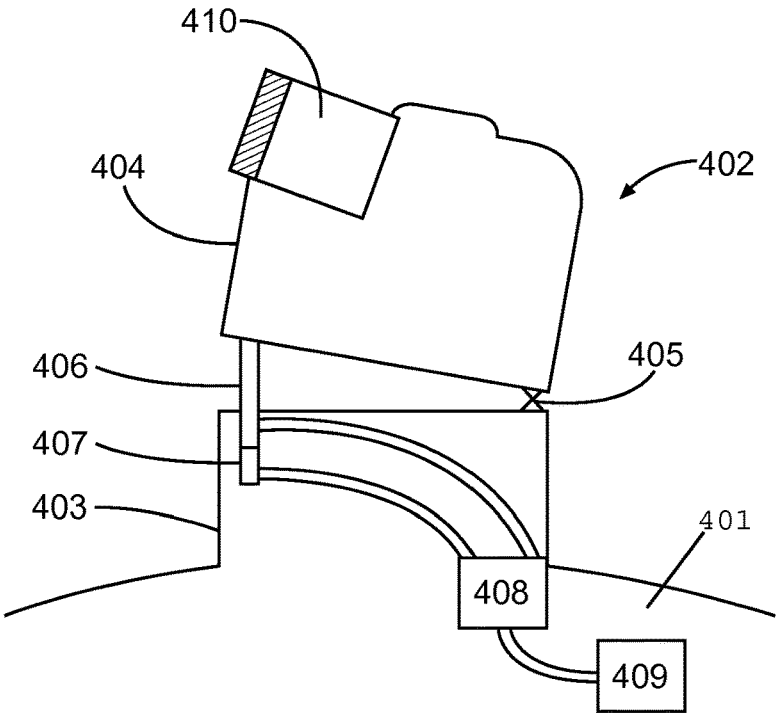
FIG. 4 is a diagram illustrating another example blade of a fixed cutter drill bit, according to aspects of the present disclosure.

In certain other embodiments, other materials or mechanisms may be used instead of or in addition to the compressible member 306 in the configuration shown in FIG. 3. For example, materials that expand over time in response to certain temperatures, magnetic fields, and electric field may also be used. In yet other embodiments, a fluid driven piston may be used. FIG. 4 is a diagram illustrating a cross-section of an example blade 402 positioned on a drill bit body 401. As can be seen, the blade 402 includes a similar configuration to the blade 302, with a lower portion 402 affixed to or integral with the bit body 401, and an upper portion 404 coupled to the lower portion using a hinge 405. Blade 402, however, incorporates a fluid driven piston 406 instead of a compressible member. The fluid driven piston 406 may be coupled at one end to the upper portion 404 of the blade 402 and at least partially disposed within a chamber 407 in the lower portion 403. A pump 408 may control fluid into the chamber 407 to control the position of the piston 406 within the chamber. Altering the position of the piston 406 may force the blade 402 into a flexed position, and the cutter engagement of the cutting element 410 may be increased or decreased according to the range of movement of the piston 406 within the chamber 407. In certain embodiments, the pump 408 may receive power from a downhole power source (not shown) such as a battery pack, and may be coupled to a downhole controller 409 that may control the cutter engagement by controlling the position of the piston 406.

Figure 5:
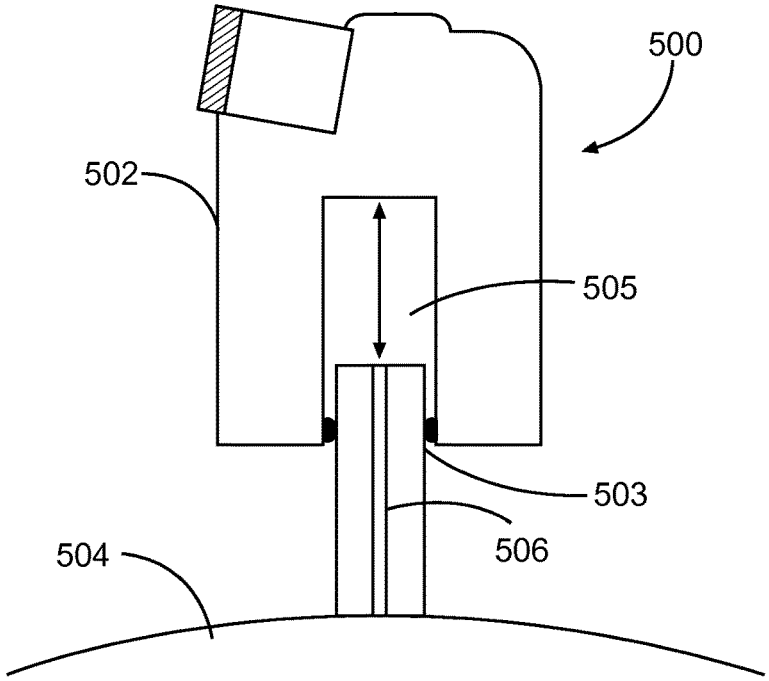
FIG. 5 is a diagram illustrating another example blade of a fixed cutter drill bit, according to aspects of the present disclosure.

In certain embodiments, a flexible blade may comprise materials with two or more different modulii of elasticity alone or in combination with mechanical, hydraulic, and/or electric mechanisms. FIG. 5 is a diagram illustrating a cross-section of an example blade 500, according to aspects of the present disclosure. In the embodiment shown, an element 503 comprised of a material with a first modulus of elasticity is affixed to or integral with the bit body 504. In certain embodiments, the element 503 may be comprised of steel, similar to the bit body 505. The element 503 may be at least partially disposed within a blade body 502 comprised of a material within a second modulus of elasticity lower than the first modulus of elasticity. The blade body 502 may move with respect to the element 503, such that the amount of element 503 disposed within the blade body 502 is variable. In certain embodiments, the position of the element within the blade body 502 may dictate a flexed position of the blade 500. Specifically, the more the element 503 is disposed within the blade body 502 the less the blade 500 will flex when subjected to an opposite force, because the effective modulus of elasticity of the blade will change. Accordingly, control of the position of the blade body 502 relative to the element 503 can be used to control flexed position of the blade 500. In an alternative environment, the element 503 may move with respect to the blade body 502, rather that the blade body 502 moving with respect to the element 503.

In certain embodiments, the position of the blade body 502 relative to the element 503 may be set manually, at the surface, before the corresponding drill bit is used in a borehole. In other embodiments, electrical or fluid control systems may be used to control the position of the blade body 502, forcing the blade 502 into a flexed position while the blade is positioned downhole. For example, the element 503 may be disposed in a sealed chamber 505 within the blade body 502. The position of the blade body 502 may be controlled by pumping fluid into the chamber 505. For example, a fluid conduit 506 may be included within the element 503 such that fluid may be pumped into the chamber 505 from a pump (not shown) positioned within the bit body 504. The blade 500 may further include a spring element (not shown) that may urge the blade body 502 toward the bit body 504 when the fluid pump is not activated. Likewise, the position of the blade may be set using a one-time trigger, such as a ball-drop mechanism.

Figure 6:
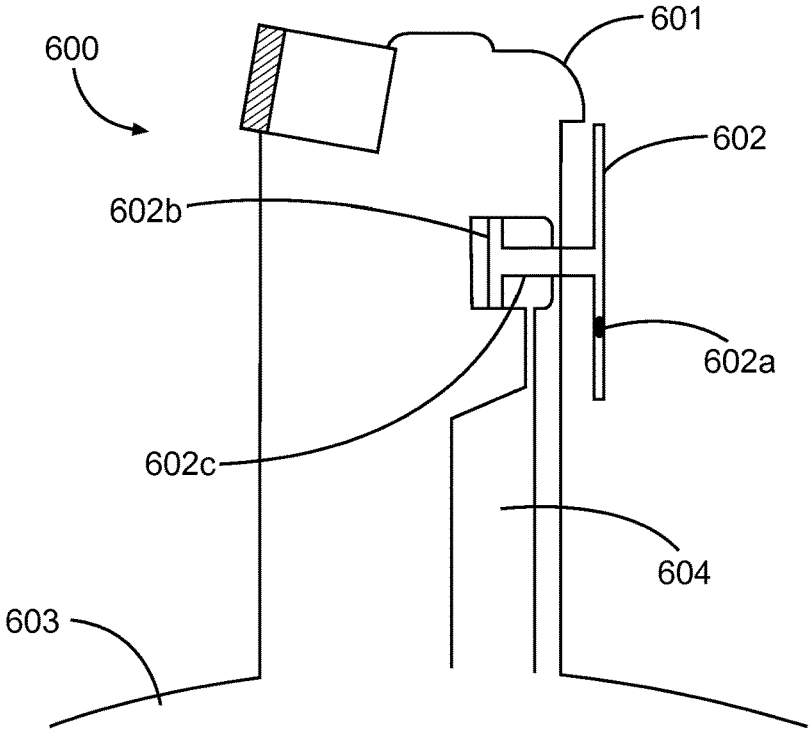
FIG. 6 is a diagram illustrating another example blade of a fixed cutter drill bit, according to aspects of the present disclosure.

Other embodiments are possible for using materials with two or more different modulli of elasticity in combination with mechanical, hydraulic, and/or electric mechanisms to force the blade into a flexed position. FIG. 6, for example, is a diagram illustrating a cross-section of an example blade 600 that comprises a blade body 601 and an element 602 at least partially disposed within the blade body 602. Like the blade in FIG. 5, the blade body 601 may be at least partially comprised of a material with a first modulus of elasticity, and the element 602 may be at least partially comprised of a material with a second modulus of elasticity greater than the first modulus of elasticity. Unlike the blade in FIG. 5, however, the blade body 601 may be affixed to or integral with the bit body 603 and the element 602 may be movable with respect to the blade body 602. In the embodiment shown, the element 602 comprises a plate 602*a* positioned outside of the blade body 601, a piston 602*b* positioned within a fluid chamber 605 of the bit body 601, and a connector 602*c* connected to both the plate 602*a* and the piston 602*b* and that is disposed partially within and partially outside of the blade body 601. The position of the plate 602*a* relative to the blade body 601 may be controlled by pumping fluid into chamber 605 and moving the piston 602*b*. Fluid may be pumped, for example, through fluid passage 604, which may be connected to a fluid pump (not shown) in the bit body 603. When the plate 602*a* is in contact with the blade body 601, it may reduce the flexibility of the blade 600 due to its higher modulus of elasticity than the blade body 601. When the plate 602*a* is not contacting the blade body 601, however, the lower modulus of elasticity of the blade body 601 may allow for a greater amount of flexibility. The amount of flex in the blade 600, however, may still be controlled using one or more drilling parameters, as described above.

Figure 7:
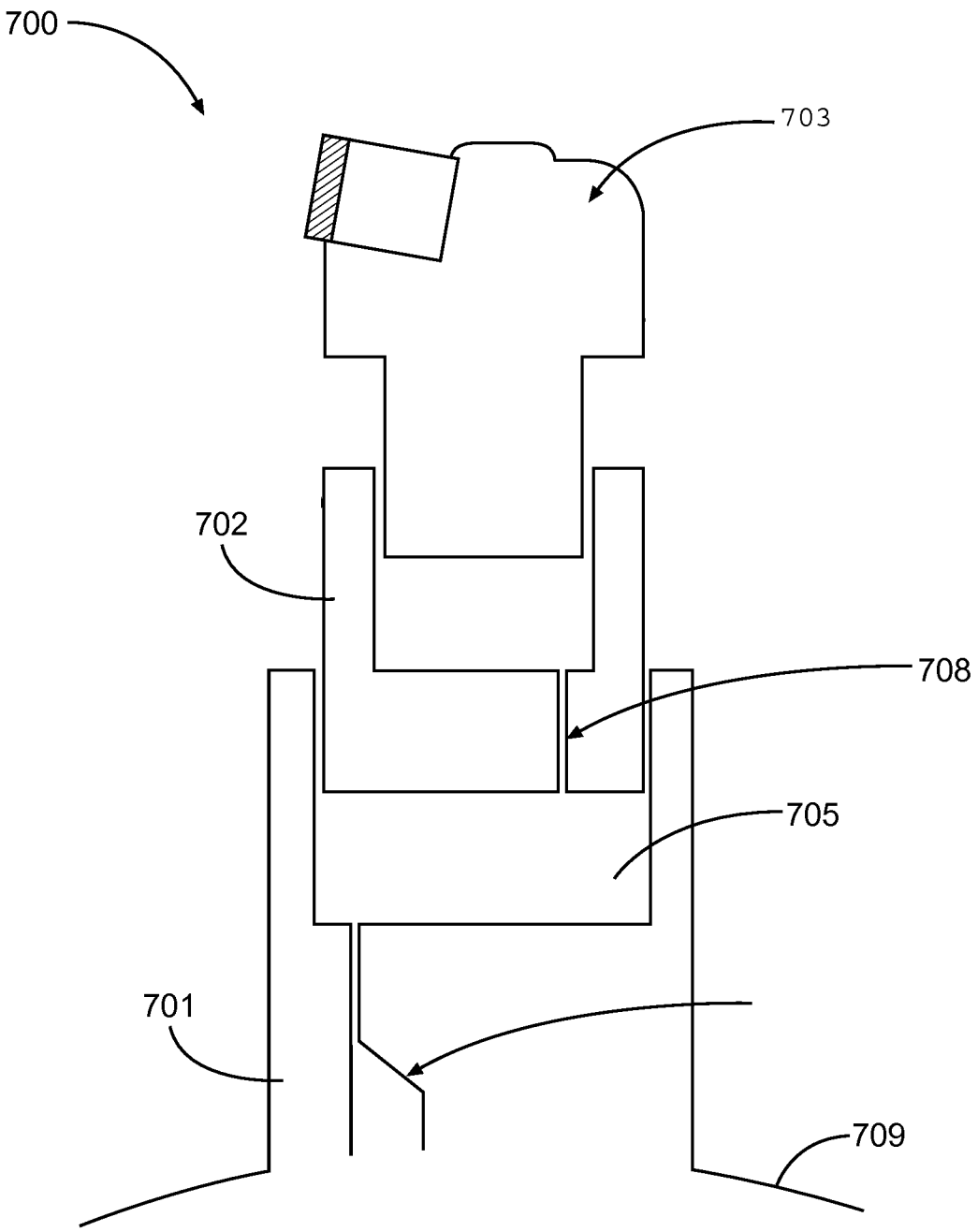
FIG. 7 is a diagram illustrating another example blade of a fixed cutter drill bit, according to aspects of the present disclosure.

FIG. 7 is a diagram illustrating a cross-section of an example blade 700 comprising three portions: a first portion 701 with a first modulus of elasticity, a second portion 702 with a second modulus of elasticity, and a third portion 703 with a third modulus of elasticity. The first portion 701 may be coupled to or formed integrally with the bit body 704. The second portion 702 may be at least partially disposed within and extendable from the first portion 701. Likewise, the third portion 703 may be at least partially disposed within and extendable from the second portion 702. In the embodiment shown, a part of the second portion 702 may be sealed within a fluid chamber 705 disposed within the first portion 701. Fluid may be pumped into the chamber 705 through a fluid passage 706 in the first portion 701. As pressure builds within the chamber 706, the second portion 702 may extend further from the first portion 701. When the pressure surpasses a threshold, the fluid may begin filling a second fluid chamber 707 disposed in the second portion 702. The fluid may travel through a second fluid passage 708 within the second portion. The third portion 703 may be at least partially disposed within the second chamber 703, and may be extended from the second portion 702 as pressure builds within the second chamber 708.

In certain embodiments, the first modulus of elasticity may be larger than the second modulus of elasticity, which in turn may be larger than the third modulus of elasticity. In certain embodiments, the modulli of elasticity may be set by selecting the section sizes of the different portions. The relative position of the portions may determine the effective modulus of elasticity of the blade, and therefore the flexibility of blade. When fluid is not introduced into the blade 700, the first modulus of elasticity may dominate and provide a first flexibility. When the second portion 702 is extended from first portion 701, the exposure of the second portion 702 at the second modulus of elasticity to the drilling forces may provide a second flexibility, greater than the first flexibility. Likewise, when the third portion 703 is extended from second portion 702, the exposure of the third portion 703 at the third modulus of elasticity to the drilling forces may provide a third flexibility, greater than the first and second flexibilities. Accordingly, the amount of flexibility of the blade may be controlled through a fluid pressure within the chambers and passage of the blade 700. Other control mechanisms are possible, as would be appreciated by one of ordinary skill in the art in view of this disclosure.

Figure 8:
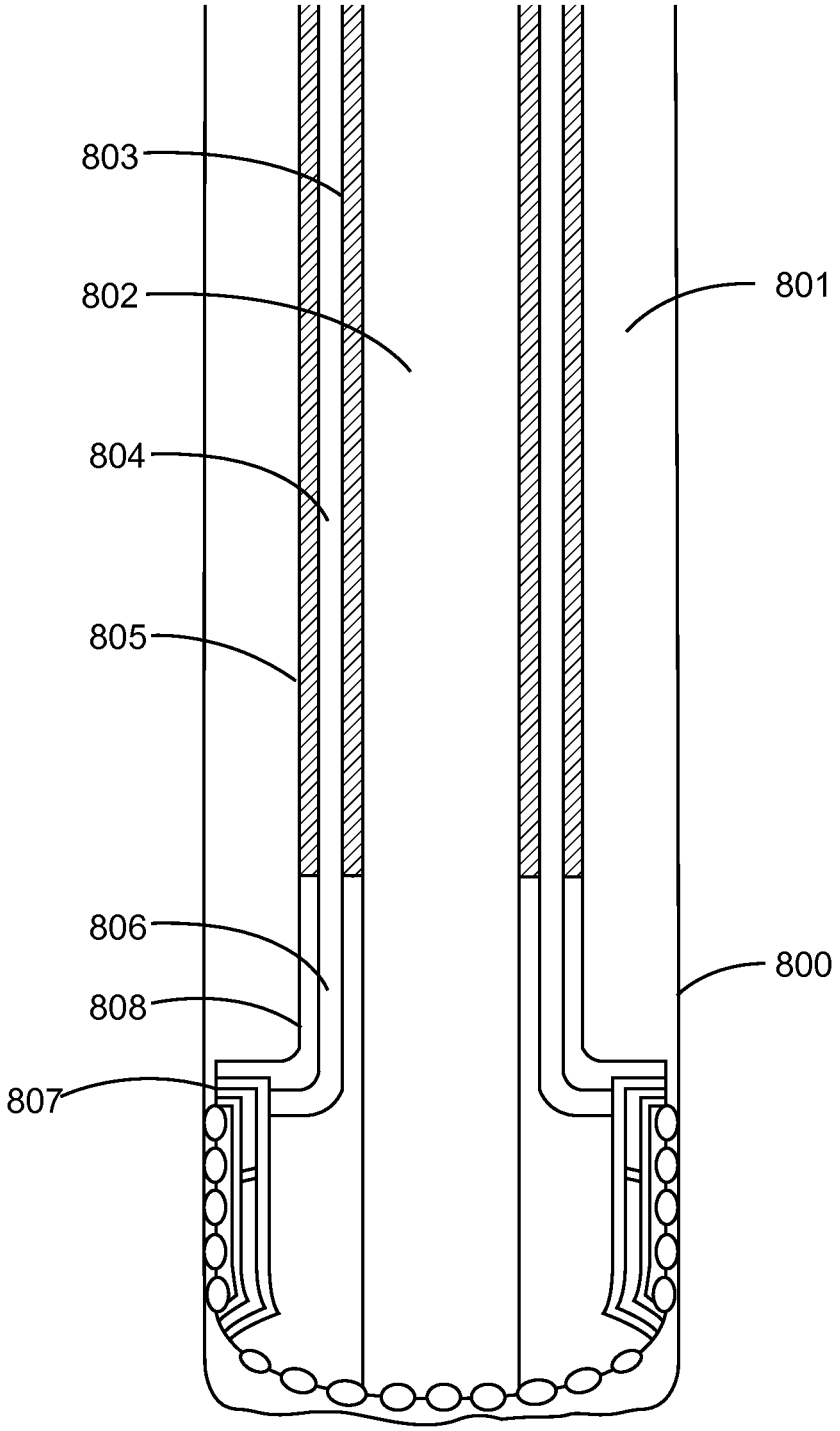
FIG. 8 is a diagram illustrating an example drill bit with a dual fluid pathway drilling assembly, according to aspects of the present disclosure.

In certain embodiments, the fluid pressure within the chambers of the blade may be controlled by a fluid pump located within the drill bit, as described above. In other embodiments, however, the fluid pressure may be controlled from the surface. FIG. 8 is a diagram illustrating an example drill bit 800 and drilling assembly 801 that provides dual fluid pathways to the drill bit 800. The first pathway 802 may be within the bore of an inner pipe or tubular 803. Drilling fluid may be communicated from the surface through the drill bit 800 using the first pathway. The second pathway 804 may comprise an annulus between the inner pipe 803 and an outer pipe or tubular 805 coupled to the drill bit 800. The second pathway may be in fluid communication with an integral fluid pathway 806 within the drill bit 800. Fluid that travels through the second pathway 804 may flow into at least one fluid chamber 807 within a blade 808, similar to the fluid chambers and blade described in FIG. 7.

Figure 9:
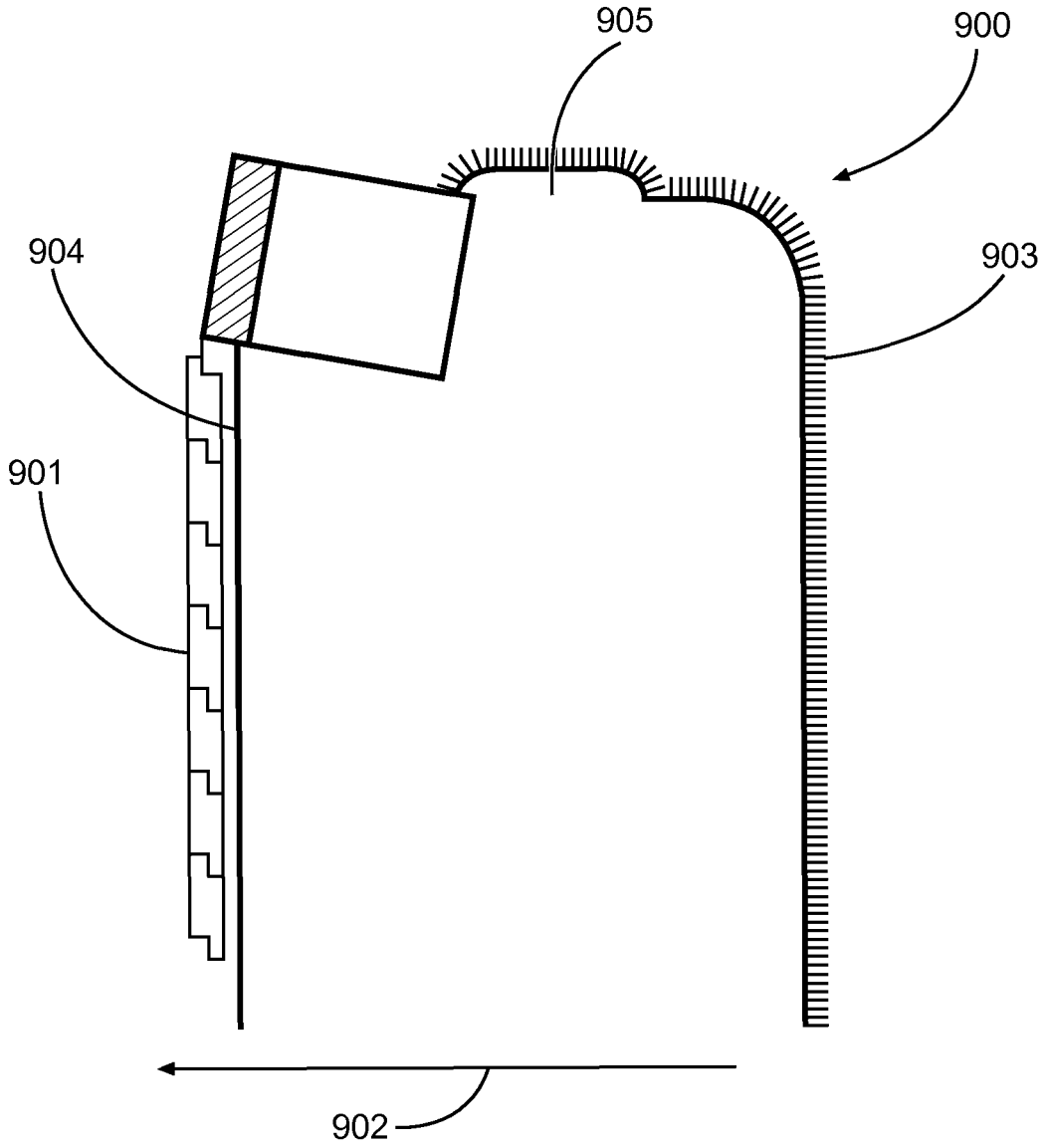
FIG. 9 is a diagram illustrating another example blade of a fixed cutter drill bit, according to aspects of the present disclosure.

In any of the embodiments described herein, at least one wear resistance material may be disposed on a surface of the blade. FIG. 9 is a diagram illustrating an example blade 900 with wear resistant material, according to aspects of the present disclosure. One example wear resistance material comprises interlocking wear resistance panels 901 arranged on a surface of the blade 900. In the embodiment shown, the blade 900 is subjected to torque force in a direction 902. The interlocking wear resistance panels may be arranged on a surface 904 of the blade 900 that faces the direction 903 of the torque force. In certain instances, the surface 904 may receive direct contact with a formation or cuttings from the formation. The interlocking panels 901 may move independently as the blade 900 flexes, providing protection from abrasive materials from the formation. Although the interlocking panels 901 are shown covering the surface 904, they may be used in numerous locations and arrangements on the blade 900, including covering all of the exposed surfaces of the blade 900 and covering only portions or some of the exposed surfaces of the blades.

In certain embodiments, the wear resistance material may comprise a nanofiber coating 903. The nanofiber coating may function similarly to the interlocking panels 901, but on a smaller scale. In certain instances, the nanofibers may be tuned to resist wear on the face 905 of the blade 900. Similarly, the nanofibers may be tuned so that they lay down against the surface of the blade 900 to protect it. In some embodiments, the nanofiber coating 903 may be sacrificial, to protect the blade 900 as it cuts into the formation. The nanofiber coating 903 may be used in place of or in addition to the interlocking panel 901

According to aspects of the present disclosure, an example drill bit may include a drill bit body and a flexible blade positioned on the drill bit body. The drill bit further may include a cutting element coupled to and extending a distance beyond a face of the flexible blade. The cutting element may have a back rake angle and a side rake angle. At least one of the distance, back rake angle, and side rake angle may depend on a flexed position of the flexible blade.

In certain embodiments, the flexible blade may comprise at least one of a material that selectively maintains the flexed position, and a material with a modulus of elasticity that varies with at least one of temperature, pressure, magnetic field, and electrical energy. The flexible blade further may comprise at least one mechanical, hydraulic, and/or electric element. In certain embodiments, the flexible blade may comprise a first portion coupled to a second portion, and that at least one mechanical, hydraulic, and/or electric element may comprises a hinge or flex point positioned between the first portion and the second portion, and at least one of a compressible member and a fluid driven piston positioned between the first portion and the second portion.

In certain embodiments, the blade may comprise a first portion coupled to a second portion. The first portion may have a first modulus of elasticity and the second portion may have a second modulus of elasticity. A mechanical, hydraulic, and/or electric element may alters the relative positions of the first portion and the second portion. In certain embodiments, the flexible blade may further have a third portion with a third modulus of elasticity less that the first modulus of elasticity and the second modulus of elasticity, and the third portion may be at least partially within at least one of the first portion and the second portion.

According to aspects of the present disclosure, an example method for drilling operations in a subterranean formation may include coupling a drill bit to a drilling assembly. The drill bit may have a flexible blade and a cutting element coupled and extending a distance beyond a face of the flexible blade. The cutting element may have a back rake angle and a side rake angle. The drill bit may be placed in a borehole in a subterranean formation. At least one of the distance, back rake angle, and side rake angle may be changed while the drill bit is positioned within the borehole.

In certain embodiments, changing at least one of the distance, back rake angle, and side rake angle while the drill bit is positioned within the borehole may include changing at least one of a drilling parameter and an effective modulus of elasticity of the flexible blade. Changing the drilling parameter may include changing at least one of a weight-on-bit and a torque-on-bit. The flexible blade may include at least one of a material that selectively maintains a flexed position, and a material with a modulus of elasticity that varies with at least one of temperature, pressure, magnetic field, and electrical energy.

Changing at least one of the distance, back rake angle, and side rake angle while the drill bit is positioned within the borehole may include altering at least one of a mechanical, hydraulic, and/or electric element of the flexible blade. Altering at least one of a mechanical, hydraulic, and/or electric element of the blade may include causing the flexible blade to bend at a hinge or flex point positioned between a first portion and a second portion of the blade. Altering at least one of a mechanical, hydraulic, and/or electric element of the blade further may include altering at least one of a compressible member and a fluid driven piston positioned between the first portion and the second portion.

In certain embodiments, the blade may comprise a first portion coupled to a second portion, the first portion may have a first modulus of elasticity, and the second portion may have a second modulus of elasticity. Changing the effective modulus of elasticity of the flexible blade may include altering the relative positions of the first portion and the second portion. In certain embodiments, the blade further may include a third portion with a third modulus of elasticity less that the first modulus of elasticity and the second modulus of elasticity. Changing the effective modulus of elasticity of the flexible blade may include altering the relative positions of the first portion, the second portion, and the third portion.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A drill bit for subterranean drilling operations, comprising:

a drill bit body;

a flexible blade positioned on the drill bit body; and a cutting element coupled to and extending a distance beyond a face of the flexible blade, and comprising a back rake angle and a side rake angle, at least one of the distance, back rake angle, and side rake angle configured to be controllable while the drill bit is positioned within a borehole and depending on a flexed position of the flexible blade.

2. The drill bit of claim 1, wherein the flexible blade comprises at least one of:

a material that selectively maintains the flexed position; and a material with a modulus of elasticity that varies with at least one of temperature, pressure, magnetic field, and electrical energy.

3. The drill bit of claim 1, wherein the flexible blade comprises at least one mechanical, hydraulic, or electric element.

4. The drill bit of claim 3, wherein:

the flexible blade comprises a first portion coupled to a second portion; and the at least one mechanical, hydraulic, or electric element comprises:

a hinge or flex point positioned between the first portion and the second portion; and at least one of a compressible member and a fluid driven piston positioned between the first portion and the second portion.

5. The drill bit of claim 3, wherein:

the flexible blade comprises a first portion coupled to a second portion; and the first portion comprises a first modulus of elasticity and the second portion comprises a second modulus of elasticity.

6. The drill bit of claim 5, wherein the at least one mechanical, hydraulic, or electric element alters the relative positions of the first portion and the second portion.

7. The drill bit of claim 5, wherein:

the flexible blade further comprises a third portion with a third modulus of elasticity less that the first modulus of elasticity and the second modulus of elasticity; and the third portion is at least partially disposed within at least one of the first portion and the second portion.

8. The drill bit of claim 1, further comprising a wear resistance material disposed on a surface of the flexible blade.

9. The drill bit of claim 1, further comprises comprising a secondary force transfer mechanism coupled to the flexible blade.

10. A method for drilling operations in a subterranean formation, comprising:

coupling a drill bit to a drilling assembly, the drill bit comprising a flexible blade and a cutting element coupled to and extending a distance beyond a face of the flexible blade, the cutting element comprising a back rake angle and a side rake angle;

placing the drill bit in a borehole within the subterranean formation; and controlling at least one of the distance, back rake angle, and side rake angle while the drill bit is positioned within the borehole.

11. The method of claim 10, wherein controlling at least one of the distance, back rake angle, and side rake angle while the drill bit is positioned within the borehole comprises changing at least one of a drilling parameter and an effective modulus of elasticity of the flexible blade.

12. The method of claim 11, wherein changing the drilling parameter comprises changing at least one of a weight-on-bit and a torque-on-bit.

13. The method of claim 10, wherein the flexible blade comprises at least one of:

a material that selectively maintains a flexed position; and a material with a modulus of elasticity that varies with at least one of temperature, pressure, magnetic field, and electrical energy.

14. The method of claim 10, wherein controlling at least one of the distance, back rake angle, and side rake angle while the drill bit is positioned within the borehole comprises altering at least one of a mechanical, hydraulic, or electric element of the flexible blade.

15. The method of claim 14, wherein altering at least one of the mechanical, hydraulic, or electric element of the flexible blade comprises causing the flexible blade to bend at a hinge or flex point positioned between a first portion and a second portion of the flexible blade.

16. The method of claim 15, wherein altering at least one of the mechanical, hydraulic, or electric element of the flexible blade further comprises altering at least one of a compressible member and a fluid driven piston positioned between the first portion and the second portion.

17. The method of claim 11, wherein:

the flexible blade comprises a first portion coupled to a second portion; and the first portion comprises a first modulus of elasticity and the second portion comprises a second modulus of elasticity.

18. The method of claim 17, wherein changing the effective modulus of elasticity of the flexible blade comprises altering the relative positions of the first portion and the second portion.

19. The method of claim 18, wherein the flexible blade further comprises a third portion with a third modulus of elasticity less that the first modulus of elasticity and the second modulus of elasticity.

20. The method of claim 19, wherein changing the effective modulus of elasticity of the flexible blade comprises altering the relative positions of the first portion, the second portion, and the third portion.

* * * * *